US007315253B1

(12) United States Patent
Pijanowski et al.

(10) Patent No.: US 7,315,253 B1
(45) Date of Patent: Jan. 1, 2008

(54) SECURITY DEVICE AND TRANSPONDER

(75) Inventors: Stefan A. Pijanowski, Northants (GB); Peter A. Farrar, Leeds (GB); Anthony H. J. Fraser, Rutland (GB); Robert Johnston, Northants (GB); Michael D. Crossfield, Hampshire (GB); Ross P. Jones, Cambridge (GB)

(73) Assignee: MeadWestVaco Corporation, Glen Allen, VA (US)

( * ) Notice: Subject to any disclaimer, the term of this patent is extended or adjusted under 35 U.S.C. 154(b) by 164 days.

(21) Appl. No.: 11/027,938

(22) Filed: Jan. 4, 2005

Related U.S. Application Data

(63) Continuation-in-part of application No. PCT/GB03/002885, filed on Jul. 4, 2003.

(30) Foreign Application Priority Data

Jul. 4, 2002 (GB) ..... 0215397.1
Sep. 10, 2004 (GB) ..... 0420089.5

(51) Int. Cl.
*G08B 21/00* (2006.01)

(52) U.S. Cl. ..... 340/686.1; 340/572.8; 340/572.9

(58) Field of Classification Search ..... 340/686.1, 340/572.1, 572.5, 572.8, 572.9
See application file for complete search history.

(56) References Cited

U.S. PATENT DOCUMENTS 4,215,342 A * 7/1980 Horowitz ..... 340/572.4
4,709,813 A 12/1987 Wildt
4,774,504 A * 9/1988 Hartings ..... 340/572.5
5,680,782 A 10/1997 Komatsu et al.
5,782,350 A 7/1998 Weisburn et al.
5,856,782 A * 1/1999 Sasagawa et al. ..... 340/572.9
5,910,770 A * 6/1999 Ohara ..... 340/572.5
6,135,280 A 10/2000 Burdett et al.
6,222,453 B1 * 4/2001 Joyce ..... 340/572.8
6,229,444 B1 5/2001 Endo et al.
6,822,569 B1 * 11/2004 Bellum et al. ..... 340/572.1
7,075,440 B2 * 7/2006 Fabian et al. ..... 340/572.6
2004/0123311 A1 6/2004 Farrar et al.

FOREIGN PATENT DOCUMENTS

DE 2539043 A1 3/1977
EP 0 744 520 11/1996
FR 2 621 893 4/1989
GB 2 369 348 5/2002

* cited by examiner

*Primary Examiner*—John Tweel, Jr.

(57) ABSTRACT

A security device for attachment to a container having external walls such that a transponder thereon is located externally of or adjacent to one of said external walls so as to avoid being shielded by a metal layer within the container (e.g. the metal layer within a disk such as a CD or DVD). The security device is arranged to trigger an alarm signal if the container is moved within the range of an alarm unit with the security device attached thereto, and has a releasable locking mechanism to secure it to the container such that release of the locking mechanism requires the use of authorized release means. In one embodiments the transponder is located in the vicinity of a window in a metal layer, e.g. at the centre of the disk.

19 Claims, 12 Drawing Sheets

SECURITY DEVICE AND TRANSPONDER

CROSS REFERENCE TO RELATED APPLICATIONS

This application is a continuation-in-part of prior International Application PCT/GB03/002885, filed Jul. 4, 2003, the entirety (including any amendments thereto) of which is incorporated herein by reference. This application also incorporates by reference in its entirety UK patent application GB-0420089.5, filed Sep. 10, 2004.

TECHNICAL FIELD

A preferred embodiment of the invention relates to a security device and/or a transponder for attachment to a container, for example to a container housing a disk such as a CD or DVD, to help in preventing or deterring its theft from a retail outlet.

BACKGROUND ART

It is well known to use security tags on retail items which trigger an alarm when the item is taken passed alarm units located at the exit of a store without prior removal of the security tag. These are known as Electronic Article Surveillance (EAS) labels or tags. There are 3 main types of devices: electromagnetic devices, acoustic magnetic (AM) devices (which are typically in the form of a flat strip or label approximately 45 mm long×40 mm wide) and Radio Frequency (RF) tags which typically comprise either a flat coil or wire approximately 50 mm in diameter or a coil wound around a ferrite rod to form an antenna. The tag acts as a transponder, i.e., it is energized on receipt of radiation, e.g., from an alarm unit, and then transmits a signal back automatically, e.g., to the alarm unit. Other types of tags are also known, e.g., Radio Frequency ID (RFID) tags, also known as "intelligent tags" as they send additional information with the signal they transmit. These types of tags and transponders are well known, so they will not be described further.

A problem that arises with some of these devices, particularly with electromagnetic devices such as RF tags, is that they can be shielded by a metal layer, e.g. the metal layer within a CD or DVD, yet it is desirable to be able to use this form of tag as a significant proportion of retail outlets use RF alarm systems rather than AM alarm systems. Such shielding may attenuate electromagnetic signals passing therethrough and/or cause frequency shift of the signals. RF tags comprising flat coils can be used but as they are relatively large it is difficult to mount them in a position when used with a container such as a CD or DVD box where they do not suffer from shielding.

A preferred embodiment of the invention aims to provide an arrangement of a security device which helps avoid or reduce this problem.

SUMMARY

According to a first aspect of a preferred embodiment of the invention, there is provided a security device for attachment to a container having external walls such that at least a signal receiving and/or transmitting portion thereof is located externally of or adjacent to one of said external walls, the security device being arranged to trigger an alarm signal if the container is moved within the range of an alarm unit with the security device attached thereto, the security device having a releasable locking mechanism to secure it to the container such that release of the locking mechanisms requires the use of authorized release means.

According to a second aspect of a preferred embodiment of the invention, there is provided a security device for attachment to apparatus adapted to hold one or more articles which includes a layer which is non-transparent to electromagnetic radiation, the security device having a portion for receiving and/or transmitting electromagnetic radiation so as to trigger an alarm signal if the apparatus is moved within the range of an alarm unit with the security device attached thereto, said portion being located on the device such that it lies in the vicinity of a window in said layer or a gap between two such layers so as to be able to receive and/or transmit electromagnetic radiation through said window or gap when the device is attached to said apparatus.

Preferably, the security device is of a type such as described and claimed in WO 02/39451, which is hereby incorporated by reference herein in its entirety, with a non-planar RF transponder mounted thereon, preferably on (or within) a portion thereof which remains externally of a container to which the device is mounted. Such a security device may simply have a locking mechanism to releasably secure it within the container but preferably also serves to secure the contents of the container, e.g. a disk, to the container and/or to secure the container in a closed configuration.

A preferred embodiment of the invention also relates to such a security device in combination with a container adapted to receive the device.

A preferred embodiment of the invention also relates to a device arranged to receive signal receiving and/or transmitting means such that, when said signal receiving and/or transmitting means is mounted therein, a security device such as that detailed above is provided.

According to a third aspect, the present invention provides a transponder comprising a substantially flat strip of magnetic material and an elongate electrical conductor wound around the strip along at least part of its length.

The transponder preferably is a radio frequency (RF) transponder. Preferred frequency bands include the kilohertz (kHz) and megahertz (MHz) bands. An example of a particularly preferred frequency is 8.2 MHz, but other frequencies may apply.

A fourth aspect of a preferred embodiment of the invention provides an RF transponder in the form of a substantially flat strip that in use generates a magnetic dipole, wherein the axis of the dipole lies along at least part of the length of the strip.

The transponder according to the second aspect of a preferred embodiment of the invention may be a transponder according to the first aspect of a preferred embodiment of the invention, and vice versa.

A fifth aspect of a preferred embodiment of the invention provides a security device comprising a substantially flat member and a transponder according to the first or second aspect of a preferred embodiment of the invention attached thereto. The transponder of the security device preferably is arranged to trigger an alarm if the security device is brought into a magnetic field of an alarm unit. The security device therefore preferably is an anti-theft device for deterring the theft of goods from stores and the like.

The substantially flat strip of the transponder preferably is substantially co-planar with, or substantially parallel to, the substantially flat member of the security device. For example, the transponder may be mounted on or in the flat member of the security device, or otherwise embedded in the flat member of the security device. In a particularly preferred embodiment of the invention, the transponder is at least partially embedded in a polymer material (e.g. an epoxy resin) in or on the flat member of the security device. Advantageously, the polymer material may be loaded with a magnetic filler material, e.g. a ferrite material (for example as described below). Such a magnetic filler material may contribute to the generation of the magnetic dipole by the transponder, particularly in the event that the strip of magnetic material breaks in use, for example.

The security device preferably is adapted to be attached to a container or other apparatus adapted to hold a product or other article. As indicated above, a preferred embodiment of the invention has particular relevance to disks such as CDs and DVDs, and the article or product preferably comprises one or more CDs or DVDs. A preferred embodiment of the invention is, however, relevant to other types of product and other types of article.

Preferably the security device includes a locking mechanism to secure it to a container or other apparatus. Preferably the locking mechanism is releasable, such that the security device may be removed from the container or other apparatus. Advantageously, the release of the locking mechanism may require the use of authorised release means. Preferably such a locking mechanism also serves to secure the product or other article, e.g. a disk, to the container or other apparatus, and/or to secure the container in a closed configuration.

Preferably, the security device is of a type such as described and claimed in international patent application WO 02/39451, but including a transponder as described herein. Such a security device may have the above-mentioned locking mechanism to releasably secure it within a container.

The product or other article (and/or the container or other apparatus) may include an electrically conductive layer or region. For example, a CD or DVD generally includes a metal layer embedded therein (for reflecting laser light used by the CD or DVD player in use). This causes a problem in that the functioning of conventional transponders based upon magnetic dipoles normally is disrupted by the presence of such metal layers, because eddy currents generated in the metal layer by the magnetic dipole of the transponder cause attenuation of the magnetic moment generated by the transponder. Thus, the magnetic field generated by the conventional transponder when the transponder is placed in the magnetic field of an alarm unit may be insufficient to trigger the alarm.

As mentioned above, the transponder according to the present invention is in the form of a substantially flat strip whose magnetic dipole preferably lies substantially along at least part of the length thereof. Consequently, an advantage of the present invention is that by orienting the security device such that the magnetic dipole of its transponder lies approximately parallel to the electrically conductive layer or region, the attenuation of the magnetic moment generated by the transponder may be insufficient to disrupt the correct functioning of the transponder. This is because, by orienting the transponder such that its magnetic dipole is approximately parallel to the electrically conductive layer or region, the eddy currents generated by the transponder in the electrically conductive layer or region may be minimised. This is explained further below.

A sixth aspect of a preferred embodiment of the invention provides a kit of parts comprising an apparatus for holding one or more articles, and a security device according to the third aspect of a preferred embodiment of the invention adapted to be secured thereto.

Preferably the kit is arranged such that when the security device is secured to the apparatus, the magnetic dipole generated in use by the transponder is oriented substantially parallel to an electrically conductive layer or region of an article held by the apparatus. Advantageously, for those embodiments of the invention in which the article is a media storage disk (e.g. a CD or a DVD), the longitudinal centre of the axis of the magnetic dipole generated by the transponder preferably is adjacent to a window in the electrically conductive layer of the disk (e.g. a window around the central hole provided in the disk). In this way, the generation of eddy currents in the electrically conductive layer by the transponder may be minimised. Additionally or alternatively, the axis of the magnetic dipole generated by the transponder may extend between two such disks.

Advantageously, the kit may be arranged such that when the security device is secured to the apparatus, the transponder of the security device is adjacent to an external wall of the apparatus. Preferably the transponder of the security device is housed within the apparatus, e.g. adjacent to an external wall of the apparatus.

The flat strip of magnetic material of the transponder may, for example, have a simple rectangular shape. However, in at least some preferred embodiments of the invention, part of the length of the strip may have a narrower width than the remainder of the strip. For example, the strip may have an approximate H-shape. Advantageously, the elongate electrical conductor may be wound around only the narrower part of the strip.

The flat strip of magnetic material of the transponder preferably is a ferromagnetic material or a ferrimagnetic material. Preferred such materials include ferrites, especially a mixed oxide of iron and nickel and/or zinc and/or cobalt and/or manganese. Such materials generally comprise ceramics. Examples of two particularly preferred nickel-zinc ferrites, chosen by experimentation by the present inventors, are: F16 supplied by TT Electronics and 4C65 supplied by Philips.

It is possible that in at least some embodiments of the invention, the flat strip of magnetic material of the transponder is susceptible to damage. This is particularly the case, for example, when the strip is formed from a ferrite material, because such materials often tend to be brittle. Advantageously, therefore, the strip of magnetic material may be provided with one or more region(s) of weakness, whereby the strip is arranged to break preferentially at such region(s) when subjected to mechanical distortion or shock. Preferably, the or each region of weakness is located away from, or adjacent to, a region of the magnetic strip around which the elongate electrical conductor is wound. This has the advantage of effectively protecting (at least to a degree) the region of the magnetic strip around which the elongate electrical conductor is wound, since this region has been found to have the greatest effect upon the strength of the magnetic field generated by the transponder. The (or each) such region of weakness may comprise a score mark (e.g. a groove) provided in the surface of the strip, or a cut-away region (e.g. a V-cut) of the strip, for example.

The above-mentioned polymer material loaded with magnetic filler (e.g. ferrite material) may also have the effect of helping to preserve at least some of the magnetic field generated by the transponder, in the event that the flat strip of the transponder breaks. If some or all of the flat strip is at least partially embedded in such filled polymer material, in the event of a gap being formed in the strip due to a fracture, at least some of the magnetic field may be channeled through the polymer material in the region of the fracture, for example.

The elongate electrical conductor preferably comprises a metal wire. The wire or other conductor may comprise a single strand or strip. Preferably, however, the wire comprises a plurality of strands, and most preferably is a multi-strand wire. The multi-strand wire may be woven or braided, for example, and preferably is Litz wire. Such multi-stranded wires have the advantage of reducing eddy current effects, for example due to skin effects and/or proximity effects.

The diameter of each strand of wire preferably is at least 0.01 mm, more preferably at least 0.02 mm, especially at least 0.03 mm. The diameter of each strand of wire preferably is no greater than 0.06 mm, more preferably no greater than 0.05 mm, especially no greater than 0.045 mm, and for example 0.04 mm. Preferably the wire comprises at least 15 strands, more preferably at least 20 strands, and preferably no more than 50 strands, more preferably no more than 40 strands, for example 25 strands. Such wires have been chosen by experimentation by the present inventors.

The inventors have also found that the winding density of the windings of the elongate electrical conductor around the strip of magnetic material has an important effect upon the performance of the transponder. The inventors have found that a winding density of at least 0.4 turns/mm and no greater than 1.0 turns/mm provides an optimum range. More preferably, the winding density range is between 0.44 turns/mm and 0.96 turns/mm, especially between 0.6 turns/mm and 0.76 turns/mm, for example 0.68 turns/mm. Such winding densities have been found by the present inventors to maximise the magnetic filed generated by the transponder. (For the avoidance of doubt, one "turn" is a single complete winding revolution around the strip.) Some experimental results obtained by the present inventors are provided below:

| Winding Density (turns/mm) | Relative Magnetic Field Strength Generated By Transponder (arbitrary units) |
|---|---|
| 0.96 | 0.78 |
| 0.68 | 1.00 |
| 0.44 | 0.74 |

The transponder preferably includes a capacitor. The capacitor preferably is electrically connected between ends of the elongate electrical conductor that is wound around the strip of magnetic material. The capacitance of the capacitor preferably is no more than 100 pF, but the choice of capacitance will depend upon the particular requirements of the transponder, and may be determined by the skilled person via trial and error. The capacitance is generally chosen to make the transponder resonate at or near the frequency of interest; as the skilled person knows, if the inductance of the electrical conductor is L and the frequency of interest is f then the capacitance preferably should be close to $$C = \frac{1}{(2\pi f)^2 L}.$$

Other preferred and optional features of preferred embodiments of the invention will be apparent from the following description and from the subsidiary claims of the specification.

BRIEF DESCRIPTION OF DRAWINGS

Preferred embodiments of the invention will now be further described, namely by way of example, with reference to the accompanying drawings, in which.

DETAILED DESCRIPTION

The embodiment of the security device illustrated in FIGS. 1-5 is designed for use with a CD or DVD container of the type described in WO 02/39451, the disclosure of which is incorporated herein. The security device may, however, be used with other types of container.

Figure 1:
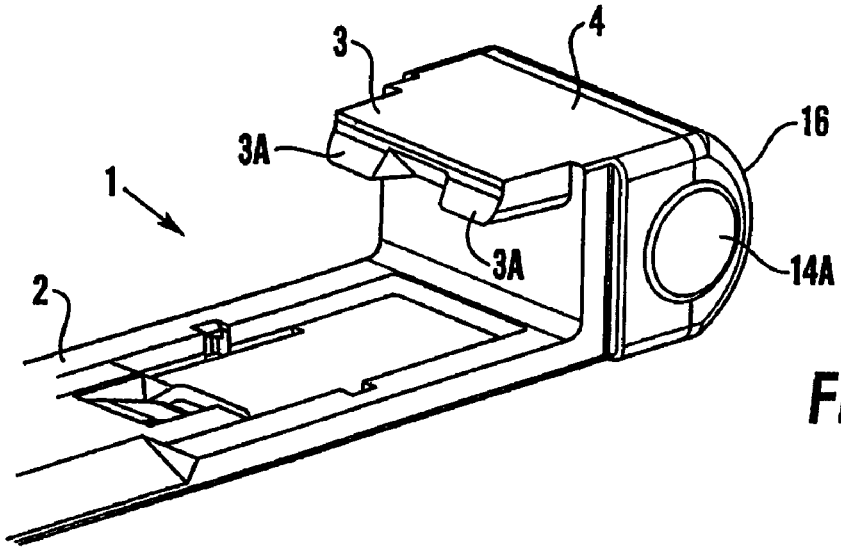
FIG. 1 is a perspective view of part of a security device according to a first embodiment of the invention.
Figure 2:
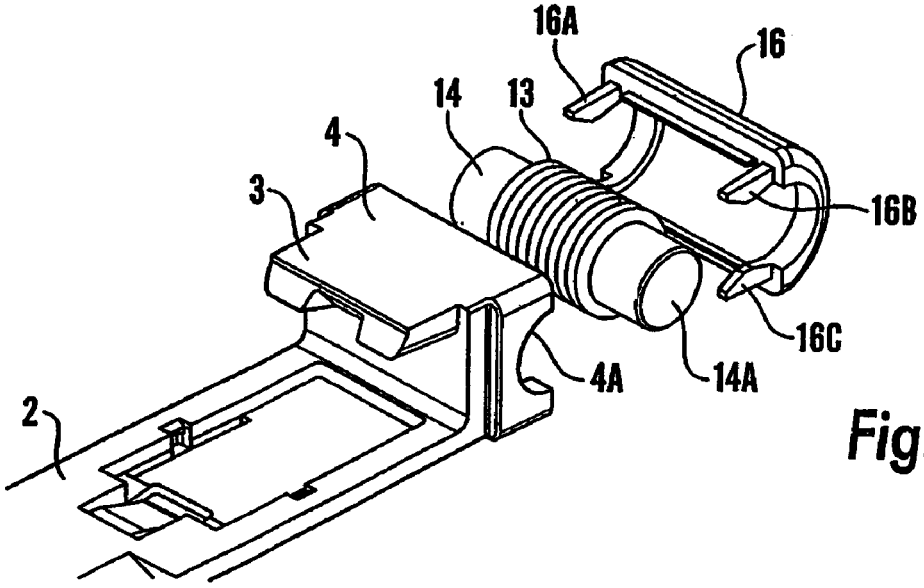
FIG. 2 is an exploded perspective view corresponding to that shown in FIG. 1.
Figure 3:
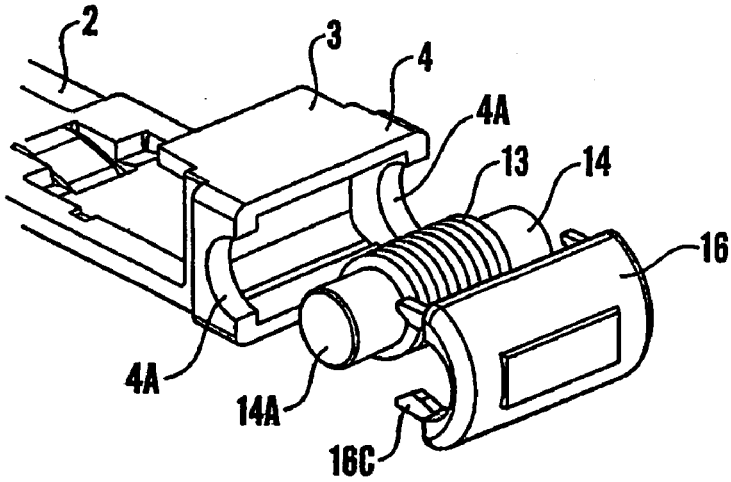
FIG. 3 is an exploded perspective view from another direction of the part shown in FIG. 1.
Figure 4:
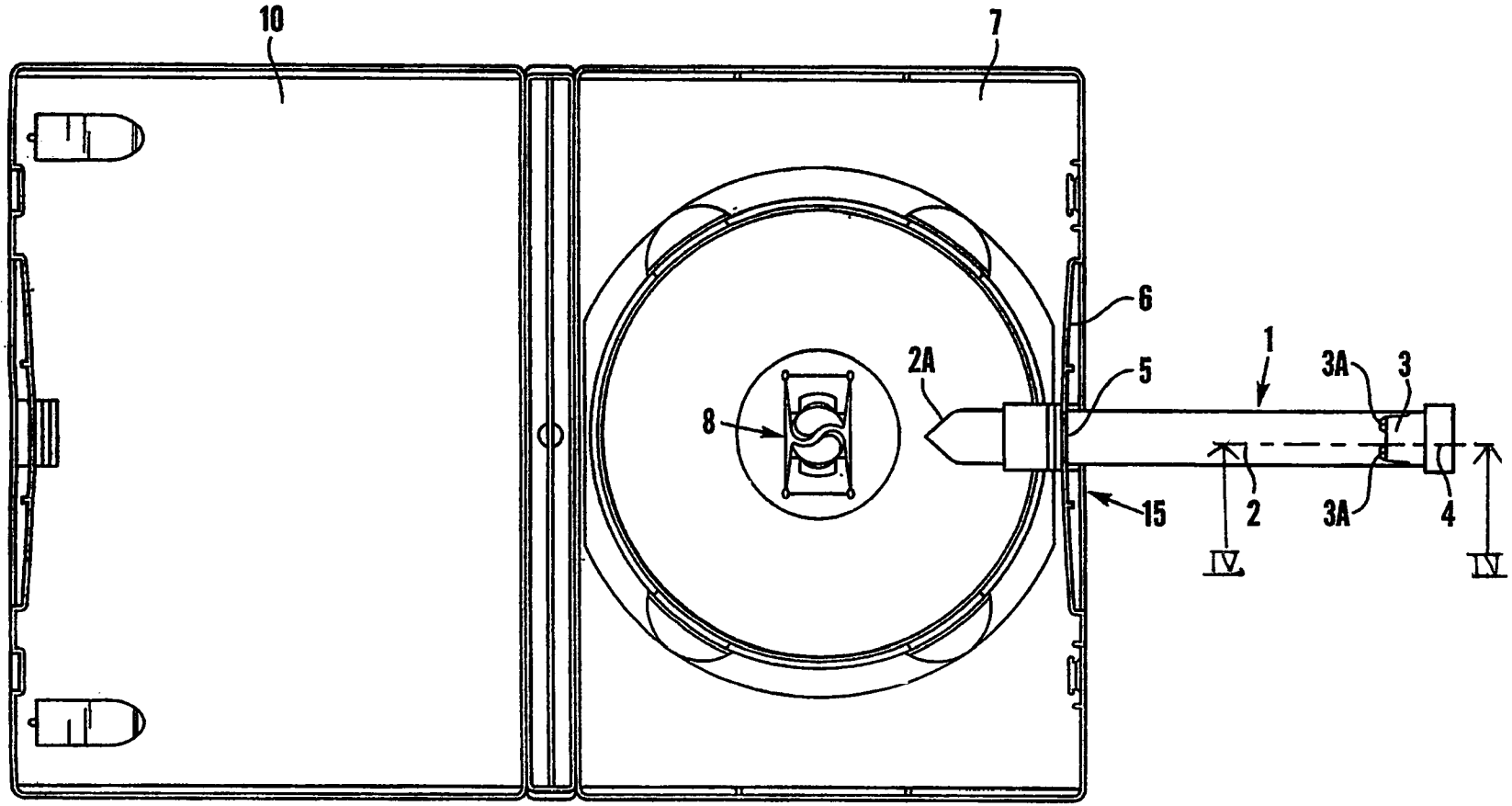
FIG. 4 is a plan view illustrating the use of a device as shown on FIGS. 1-3 with a CD or DVD container.
Figure 5:
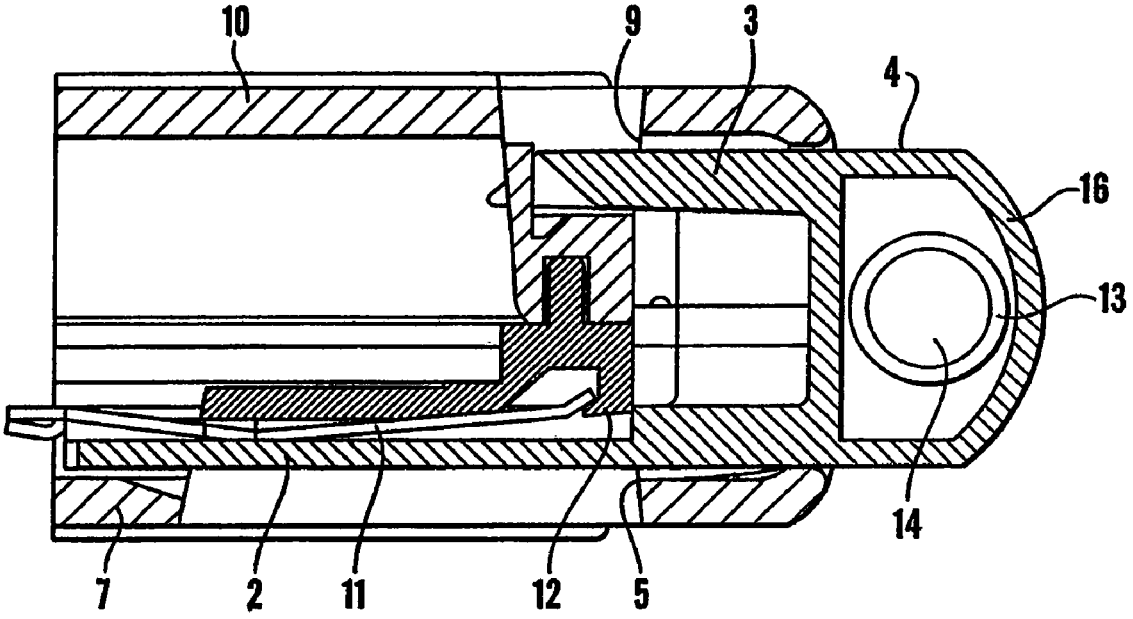
FIG. 5 is a cross-sectional view taken along line VI-VI of FIG. 4 (with the security device inserted further into the container)

The security tag 1 shown in FIGS. 1-3 comprises a long arm 2 and a short arm 3 both arms projecting from a head portion 4. The long and short arm 2, 3 may be similar to those described in WO 02/39451. As shown in FIG. 4, the long arm 2 is designed to be inserted through an aperture or slot 5 in a side wall 6 of a base portion of a DVD container. Preferably, it extends across the base portion 7 and interacts with disk-holding means 8 on the base portion 7 to lock the disk (not shown) onto the base portion 7 as described in WO 02/39451. As shown in FIG. 5, the short arm 3 is designed to be inserted through an aperture or slot 9 in a side wall of a lid portion 10 of the container which is hingedly attached to the base portion 7 along an edge thereof so as to hold the lid portion 10 in a closed position relative to the base portion.

The arms 2, 3 and the head portion 4 are preferably formed of a plastics material.

The long arm 2 is provided with a releasable locking mechanism which, once the long arm has been inserted into the container, locks the device to the container until it is released therefrom, e.g. by a magnetic release apparatus, such as may be provided behind the counter in a retail outlet. In the embodiment shown in FIG. 5, the locking mechanism comprises a metal pivot arm 11 which, once the security tag 1 has been inserted into the container, engages a detent 12 within the base portion 7 so providing a snap-fit which prevents withdrawal of the security device 1 from the container until the pivot arm 11 is moved, e.g. by a magnetic release device or a specially shaped key, out of engagement with the detent 12 (the metal pivot arm 11 is not shown in FIGS. 1-3). This and other locking mechanisms are described further in WO 02/039451. The locking mechanism is preferably arranged to be capable of repeated locking and unlocking so the device can be re-used many times.

The security device described in W002/39451 holds an AM flatstrip type security tag within a recess towards the distal end of the long arm 2 thereof. In contrast, the security device illustrated in FIGS. 1-5 has a non-planar RF type security tag in the form of a coil 13 wound around a magnetic core 14, e.g. a ferrite rod, mounted within the head portion 4. The coil 13 is connected to a capacitor (not shown) located adjacent thereto. WO 02/39451 discloses a head portion which is essentially planar and which has a metal plate therein to assist in withdrawal of the security tag from the container by magnetic means once the locking mechanism securing it within the container has been released. In contrast, the security device described herein comprises an enlarged head portion 4 which is shaped to accommodate the ferrite rod 14 with a coil 13 wound thereabout. The ferrite rod 14 typically has a length in the range 15-20 mm and a diameter (including the coil) of around 5-10 mm.

This ferrite rod 14 and coil 13 act as a transponder for receiving a radio frequency signal from an alarm unit and transmitting a signal back to the alarm unit. By mounting the transponder externally of the container it is well positioned to communicate with the alarm unit. In particular, when mounted in the position shown adjacent a narrow edge of the container, it is located substantially within the plane occupied by a CD or DVD (or other contents of the container) held within the container. The transponder is thus located substantially co-planar with the metal layer within the CD or DVD (or other contents of the container) so is not shielded by the metal layer whatever the orientation of the container relative to the alarm unit.

Furthermore, the transponder is located remote from the contents of the container. As the transponder include a magnetic member this may be desirable to avoid damaging the contents of the container if they are susceptible to magnetic fields.

Mounting the transponder externally also avoids occupying space within the container so it does not interfere with the contents or reduce the volume available for housing contents within the container.

The security device can also be installed in the container when the latter is in a closed configuration.

The enlarged head portion 4 projects from the container and thus increases its external dimension but only in a localised area along the opening side of the container so has a negligible effect upon the storage or shelving requirements for displaying the product within a retail outlet. The head portion 4 is also preferably mounted within a finger recess 15 provided along the opening edge of the container to reduce the distance by which it projects beyond the external dimensions of the container.

In other arrangements, the transponder may be mounted externally in other locations on the container or mounted adjacent an external wall of the container. In the latter case, it may be housed within the container and/or so that it does not project beyond the external dimensions thereof. An example of this is described further below with reference to FIG. 6.

The arrangement shown in FIGS. 1-5 has a further significant advantage in that the ferrite rod 14 performs two functions. First, it forms part of the RF transponder and, secondly, as it is magnetic, it can be used to assist in withdrawal of the security device from the container by magnetic means so performs the role of the metal plate provided in the head portion 4 such as described in WO 02/39451. As ferrite is less strongly attracted by a magnetic force than a metal insert, to enable reliable functioning of the release apparatus in withdrawing the device from a container, the type of ferrite used preferably has high ferromagnetic properties and it is preferably located as close as possible to the outermost facing surface of the head 4. If the security device is intended to be re-used, the ferrite rod 14 is also preferably magnetically saturated so that it retains its magnetism and is not deactivated in the presence of a magnetic field.

There are various ways of mounting the ferrite transponder in the head portion 4 of the security device. In a preferred method, the head portion comprises a cover 16 which fits onto the security device to locate the transponder and hold it in place within the head portion 4. The cover 16 is preferably a snap-fit onto the device so that once it is located in place it cannot be removed without breaking open the head portion 4 or by the application of a specialised release tool or key. Preferably, the outer wall of the cover 16 is thin, e.g. 1 mm or less or 0.5 mm or less in thickness, so the ferrite rod 14 is located as close as possible to the external surface thereof to maximise the magnetic force applied thereto when the head 4 is brought up to a magnet in the release apparatus.

FIGS. 2 and 3 show a cover 16 having four projecting arms 16A, 16B, 16C and 16D which snap-fit into sockets or recesses (not shown) provided in the head portion 4 of the security device. The cover 16 and the outer end 4A of the head portion 4 are shaped to locate the cylindrical ferrite rod and secure it within the head portion 4. In the arrangement shown, the ends 14A and 14B of the ferrite rod 14 are exposed on each side of the head portion 4 to enable the length of the rod to be maximised within the limited space available. In other embodiments, the ferrite rod 14 may be completely concealed within the head portion 4.

The head portion 4 is preferably shaped so as to make it difficult to obtain a purchase thereon to try to pull the security tag out of the container without authorised release of the locking mechanism. To this end, it preferably has a curved outer surface as shown which, in use, faces outward from the container. This curved form also helps minimise the amount of plastic shielding the ferrite rod 14 from a magnetic field applied thereto when magnetic release apparatus is used to withdraw the device from the container. In another embodiment (not shown) the ends of the head portion 4 adjacent the ends of the ferrite rod 14 may also have a curved form for the same reason.

RF security tags may be designed to be deactivated by a deactivation unit behind the counter in a retail outlet in which case there is no need to remove the security tag from the container when a customer purchases the container. In this case, the security tag may be designed for a single use only and disposed of by the customer.

Other types of security tags can be deactivated and then reactivated so they can be re-used. In this case, the retail outlet may deactivate the tag and then remove it before the customer takes the container away.

However, the preferred form of RF security tag for use with the arrangement described herein is a permanent form which cannot be deactivated as this increases the level of security provided by the tag. In this case, the tag must be removed from the container prior to the customer taking the container out of the store. As such security tags are designed for multiple re-use, there are less cost restraints on its design so higher quality components may be used.

The RF security tag can be arranged to send an identification signal or other data to the alarm unit but a signal simply indicating its presence is sufficient to trigger an alarm.

Magnetic release apparatus for releasing a security device such as that described herein is described in WO 02/39451 so will not be described further herein.

Whilst such magnetic locking and release devices are preferred, other embodiments may use other types of locking devices including mechanical locks and mechanical release means or keys.

The use of an RF tag having a ferrite rod is preferred as described above but other non-planar forms of transmitting and/or receiving means may be used in the positions described above.

The container with which the security device is used may typically be provided with an outer wrapping, e.g. a plastic shrink-wrapping. The security tag 1 is designed to pierce such a wrapping so the security device can be installed after application of the wrapping. The long and short arms 2 and 3 thus preferably have pointed ends 2A, 3A or are shaped so as to easily pierce such a wrapping. As the arms 2 and 3 are relatively thin and as the area in which they pierce the wrapping is, in use, concealed by the head portion 4 of the device, this does not prejudice the integrity of the wrapper nor its appearance and the shrink-wrapping remains intact. It thus still provides tamper evidence and provides reassurance to the customer that the contents have not been interfered with.

The arrangement described above thus enables a non-planar form of security tag, such as an RF device with a cylindrical core, to be used in relation to a container in a manner which avoids, or significantly reduces, the problem of shielding, is small enough to be mounted on a security device which is used to inhibit removal of a product from the container, e.g. a security device such as that described in WO 02/39451, without compromising the level of security provided by this device, yet whose performance is sufficient to provide reliable operation in triggering an alarm.

The arrangement described also has the advantage that it can still be used with existing release apparatus used to release a security device from the container, e.g. release apparatus such as that described in WO 02/39451. Moreover, a component of the security tag, e.g. a ferrite rod, is used both as part of the transponder and to assist in withdrawal of the security device from the container by magnetic release apparatus.

The arrangement thus provides a practical way of using an RF-type EAS device in relation to security devices of the type described in WO 02/39451 so they can be used in retail outlets employing RF alarm systems as well as those using AM alarm systems. The security device may, if desired, be arranged to receive both an AM tag and an RF tag. The required form of tag can then be mounted thereon, or even both types if desired.

Figure 6:
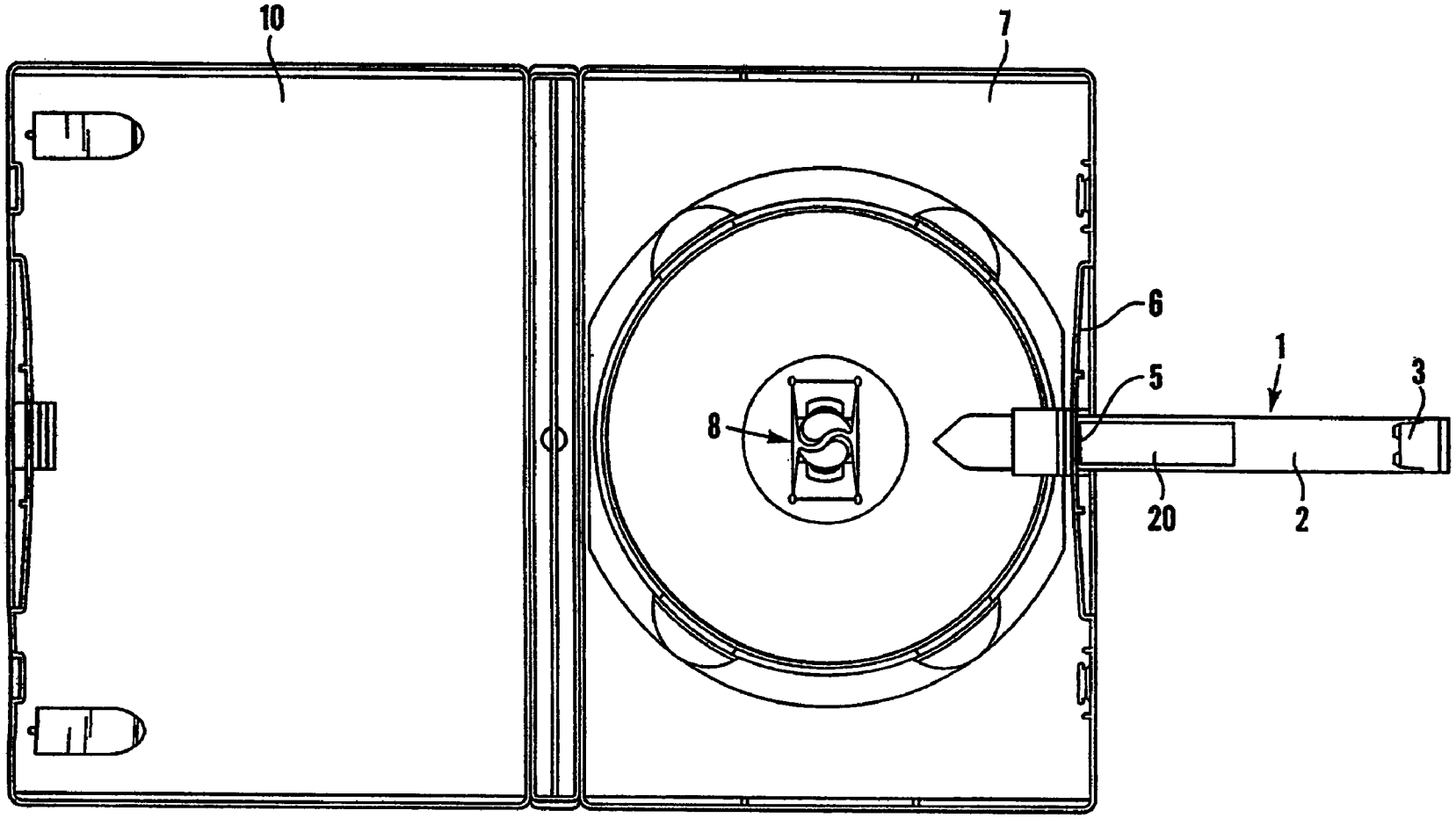
FIG. 6 is a plan view of a further embodiment of the invention showing the security device being installed in a DVD container (with the DVD omitted for clarity)
Figure 7:
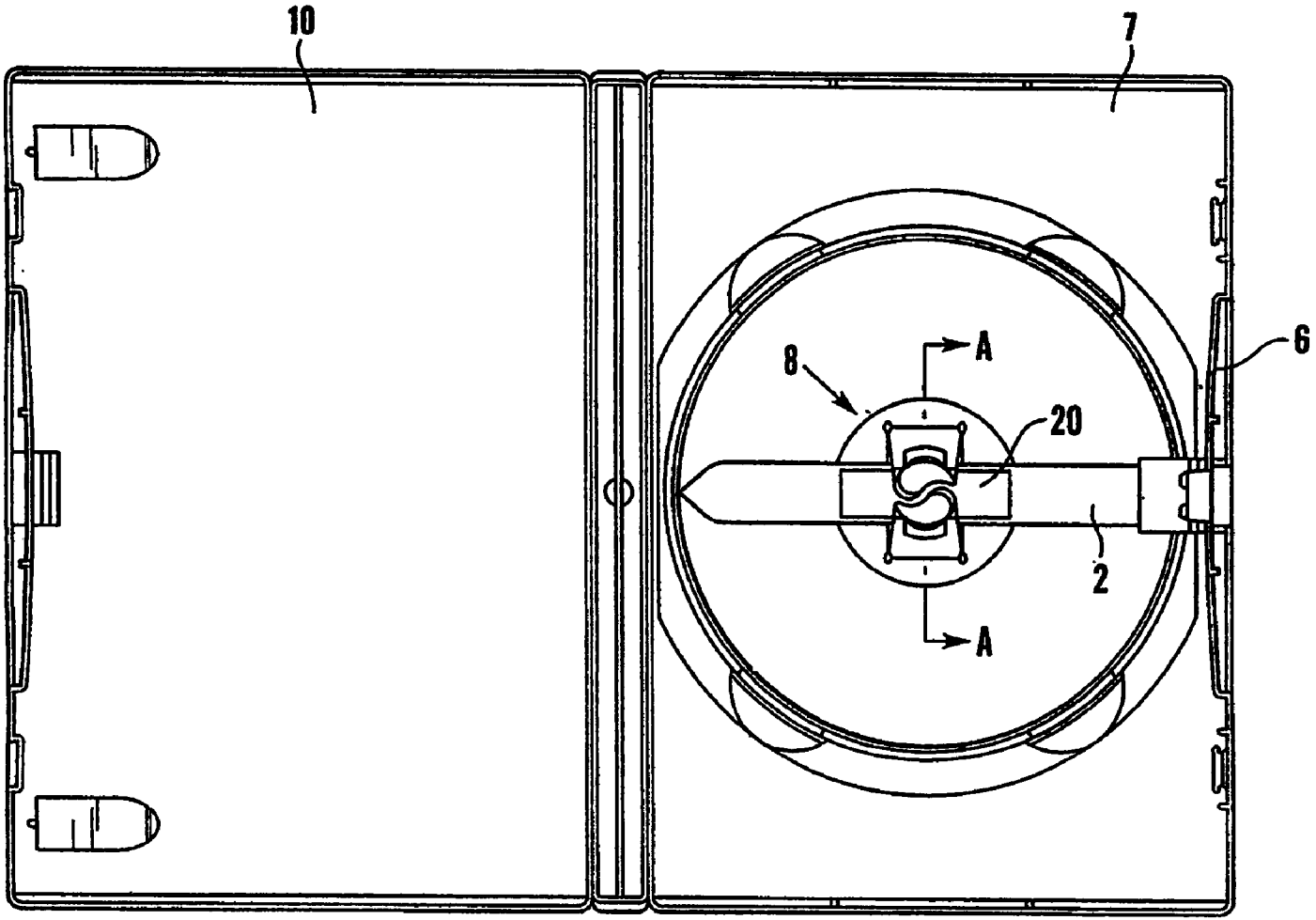
FIG. 7 is a similar view to FIG. 6 but shows the position of the security device when fully inserted into the container.

FIGS. 6 and 7 illustrate another way of mounting an RF transponder 20 on a security device 2 of the type described in W002/39451. This embodiment is based upon the realisation that another way to avoid, or reduce, the problem of shielding caused by the metal layer within a disk 21 such as a CD or DVD (see FIG. 8) is to mount the RF transponder 20 in a position which is aligned with the central region of the disk 21. Such disks have an aperture 21A in the centre thereof typically of a diameter of 15 mm. Thus, a transponder 20 located in the vicinity of the aperture in such a disk (and preferably close to the plane of the disk) will be able to receive and send signals in most directions as such signals can pass through the aperture 21A in the disk so it can communicate with an alarm system located on either side of the disk 21. Furthermore, many such disks have a region 21B around the central aperture 21A which is not provided with a metal layer 21C. Thus, the aperture in the metal layer 21C of a disk is often greater than the aperture 21A in the plastic layers between which the metal layer 21C is sandwiched. The diameter of this substantially metal free area 21B may be up to 38 mm in diameter but, more typically, is around 30 mm in diameter. There is, therefore, window of appreciable size in the centre of the disk 21 through which signals can be received by and sent from an RF transponder 20 located in that vicinity.

As indicated above, it is also highly desirable for the RF transponder 20 to be carried by the security device 2 so that it can be locked within the container and once removed can be re-used in another container. In this embodiment, the RF transponder 20 is thus mounted on the security device 2 in a position such that, in use, when the security device 2 is installed within the container 7, it lies in the vicinity of the window described above in the metal layer 21C of the disk 21.

The security device 2 typically has a width similar to the diameter of the central hole 21A of the disk. Thus, a transponder 20 with a width of 15 mm and a length of 15 to 30 mm can be mounted on the long arm of the security device 2 in a position such that, when installed, it lies under the central area of the disk 21. This means that it also lies under the disk-holding means 8 but as this is typically formed of plastic, it is transparent to the RF signals.

An RF transponder 20 of the above dimension can be provided either in the form of a flat coil of wire (or other electrical conductors) similar to that described above but wound in elongate loops rather in circles so as to fit within a 15×30 mm area on the security device 2 or in the form of a coil wound around a thin, substantially flat, ferrite core.

Figure 8:
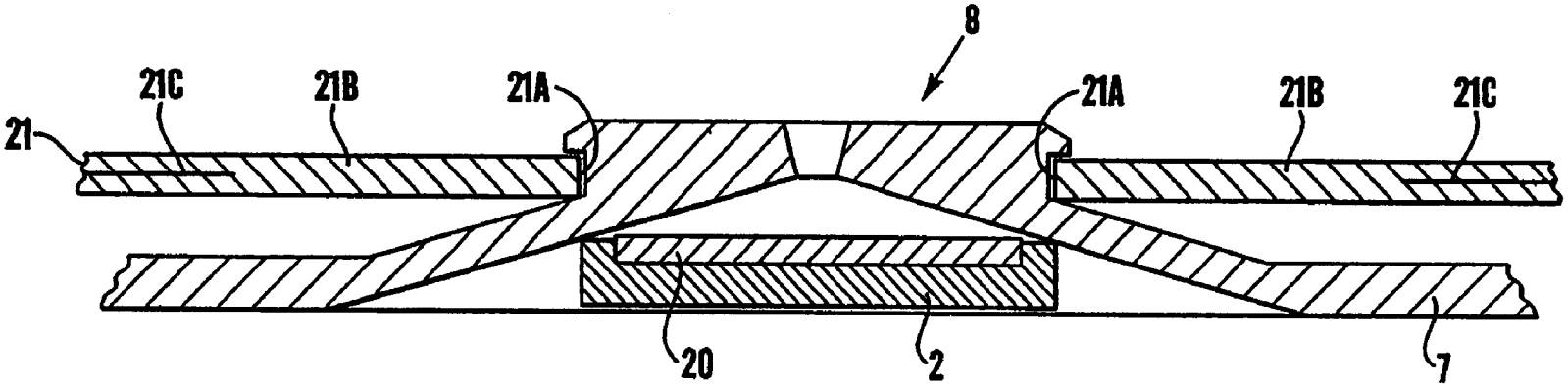
FIG. 8 is a cross-sectional view taken on line A-A of FIG. 7 (but also showing a disk held on the apparatus)

FIG. 8 shows a cross-section on line A-A of FIG. 7 through the disk holding means 8, a disk 21 held thereon and a security device 2 located under the disk holding means 8 with an RF transponder 20 mounted thereon so as to be located adjacent the disk 21 and in the vicinity of the central aperture 21A of the disk. FIG. 8 also shows the typical extent of a metal layer 21C embedded within the disk 21.

Figure 9:
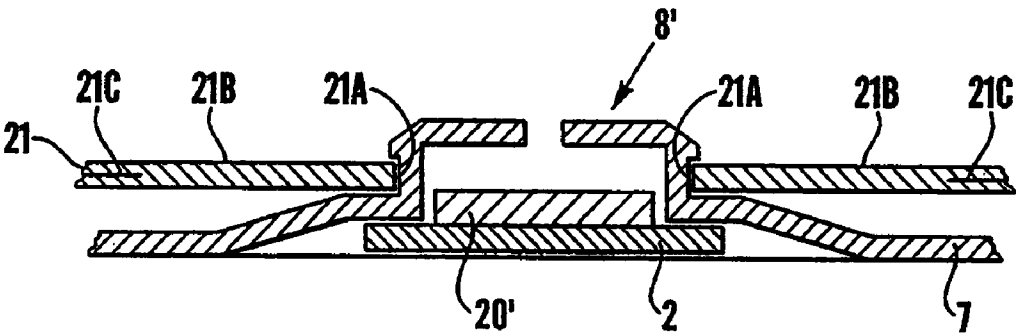
FIG. 9 is a similar cross-sectional view through a different kind of DVD container.
Figure 10:
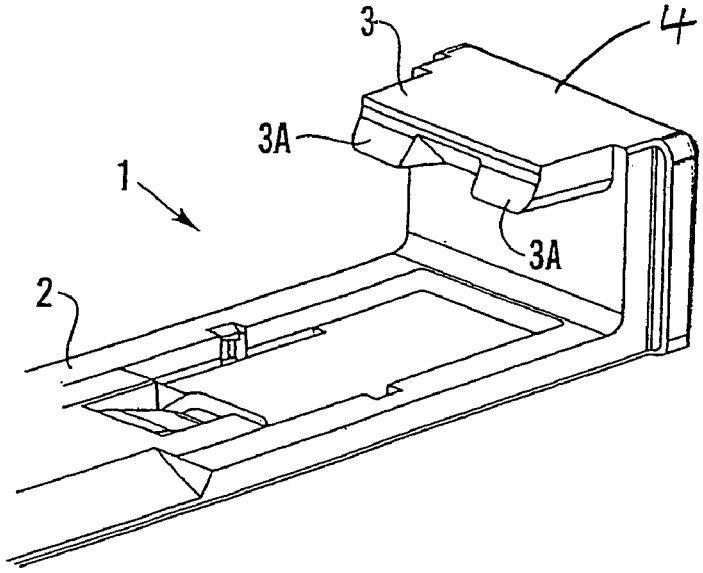
FIG. 10 is a perspective view of part of a security device according to an embodiment of the invention.

FIG. 9 shows a similar cross-section through another form of disk holding means 8' which provides more space between the above the security device 2 in the vicinity of the central hole 21A of the disk 21 and which would thus enable a preferred embodiment of the invention to be implemented with an RF transponder 20' of slightly greater thickness (perpendicular to the plane of the disk) although, in cases where the security device 2 is inserted through a slot in the extended wall of the container (e.g. slot 5 shown in FIG. 6), this would require the slot to be made slightly larger too.

A similar arrangement can be used in apparatus designed to hold other articles which have a tendency to shield electromagnetic radiation. In some cases, the container may be adapted to hold two or more such articles, e.g. side by side, in which case the security device is arranged so that the RF transponder lies in the vicinity of a gap between the articles.

The arrangements described in relation to FIGS. 6-9 have the additional advantage in that the head of the security device need not protrude beyond the external walls of the container as the transponder is mounted within the container.

The embodiment of the security device illustrated in FIGS. 10-13 is designed for use with a CD or DVD container of the type described in WO 02/39451, the entire disclosure of which is incorporated herein by reference. The security device may, however, be used with other types of container.

Figure 12:
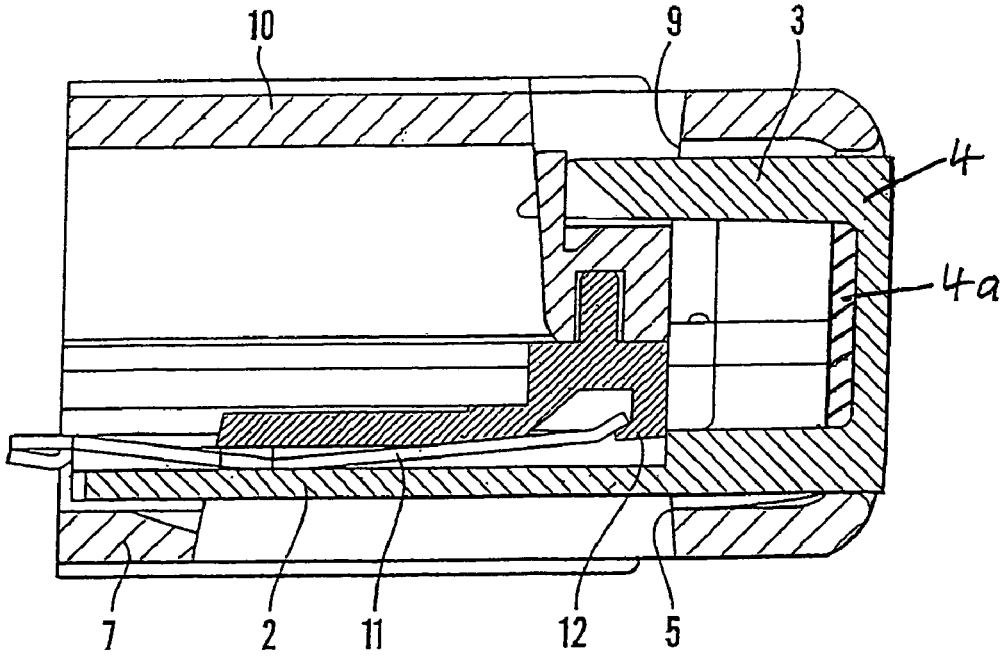
FIG. 12 is a cross-sectional view of part of a security device similar to that shown in FIGS. 10 and 11 inserted into a container as shown in FIG. 11.
Figure 11:
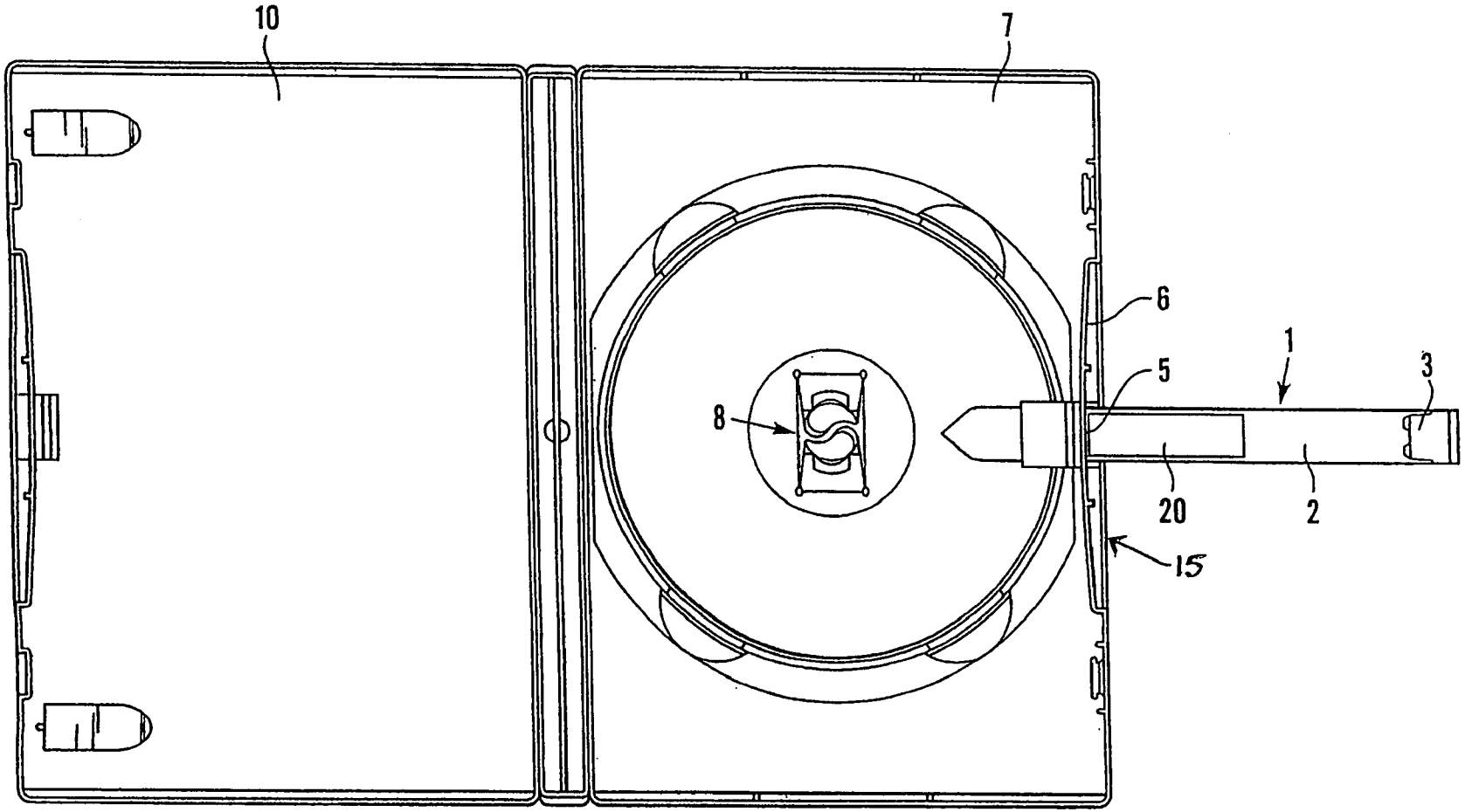
FIG. 11 is a plan view illustrating the use of a security device similar to that shown in FIG. 1, with a CD or DVD container.

The security device 1 shown in FIGS. 10-13 comprises a long arm 2 and a short arm 3, both arms projecting from a head portion 4. The long and short arms 2, 3 may be similar to those described in WO 02/39451. As shown in FIG. 11, the long arm 2 is designed to be inserted through an aperture or slot 5 in a side wall 6 of a base portion of a CD or DVD container. Preferably, it extends across the base portion 7 and interacts with disk-holding means 8 on the base portion 7 to lock the disk (not shown) onto the base portion 7 as described in WO 02/39451. As shown in FIG. 12, the short arm 3 is designed to be inserted through an aperture or slot 9 in a side wall of a lid portion 10 of the container which is hingedly attached to the base portion 7 along an edge thereof so as to hold the lid portion 10 in a closed position relative to the base portion.

The arms 2, 3 and the head portion 4 preferably are formed of a plastic material, for example a polyamide (e.g. Nylon) or ABS (an acrylonitrile-butadiene-styrene copolymer). The material may contain a reinforcement or other filler, for example a fiber filler, especially glass fibers.

The long arm 2 is provided with a releasable locking mechanism which, once the long arm has been inserted into the container, locks the device to the container until it is released therefrom, e.g. by a magnetic release apparatus, such as may be provided behind the counter in a retail outlet. In the embodiment shown in FIG. 12, the locking mechanism comprises a metal pivot arm 11 which, once the security device 1 has been inserted into the container, engages a detent 12 within the base portion 7 so providing a snap-fit which prevents withdrawal of the security device 1 from the container until the pivot arm 11 is moved, e.g. by a magnetic release device or a specially shaped key, out of engagement with the detent 12. (The metal pivot arm 11 is not shown in FIG. 10). This and other locking mechanisms are described further in WO 02/039451. The locking mechanism preferably is arranged to be capable of repeated locking and unlocking so the device can be re-used many times.

As shown in FIG. 12, the head portion 4 has a metal plate 4*a* therein to assist in withdrawal of the security tag from the container by magnetic means once the locking mechanism securing it within the container has been released. (The security device can be, and preferably is, installed in the container when the latter is in a closed configuration.)

The head portion 4 preferably is mounted within a finger recess 15 provided along the opening edge of the container to reduce the distance by which it projects beyond the external dimensions of the container.

RF security devices (tags) may be designed to be deactivated by a deactivation unit behind the counter in a retail outlet in which case there is no need to remove the security tag from the container when a customer purchases the container. In this case, the security tag may be designed for a single use only and disposed of by the customer. Other types of security tags can be deactivated and then reactivated so they can be re-used. In this case, the retail outlet may deactivate the tag and then remove it before the customer takes the container away. However, the preferred form of RF security tag for use with the arrangement described herein is a permanent form which cannot be deactivated as this increases the level of security provided by the tag. In this case, the tag must be removed from the container prior to the customer taking the container out of the store. As such security tags are designed for multiple re-use, there are less cost restraints on its design so higher quality components may be used.

The RF security tag can be arranged to send an identification signal or other data to the alarm unit but a signal simply indicating its presence is sufficient to trigger an alarm.

A magnetic release apparatus for releasing a security device such as that described herein is described in WO 02/39451 so will not be described further herein.

While such magnetic locking and release devices are preferred, other embodiments may use other types of locking devices including mechanical locks and mechanical release means or keys.

The container with which the security device is used may typically be provided with an outer wrapping, e.g. a plastic shrink-wrapping. The security device 1 is designed to pierce such a wrapping so the security device can be installed after application of the wrapping. The long and short arms 2 and 3 thus preferably have pointed ends, or are shaped so as to easily pierce such a wrapping. As the arms 2 and 3 are thin and the area in which they pierce the wrapping is, in use, concealed by the head portion 4 of the device, this does not prejudice the integrity of the wrapper or its appearance and the shrink-wrapping remains intact. It thus still provides tamper evidence and provides reassurance to the customer that the contents have not been interfered with.

The long arm 2 of the security device 1 carries a transponder 20 according to a preferred embodiment of the invention. The arm 2 of the security device 1 thus comprises the substantially flat member of the security device referred to above. As indicated above, it is highly desirable for the transponder 20 to be carried by the long arm 2 of the security device 1 so that it can be locked within the container and once removed can be re-used in another container.

Figure 13:
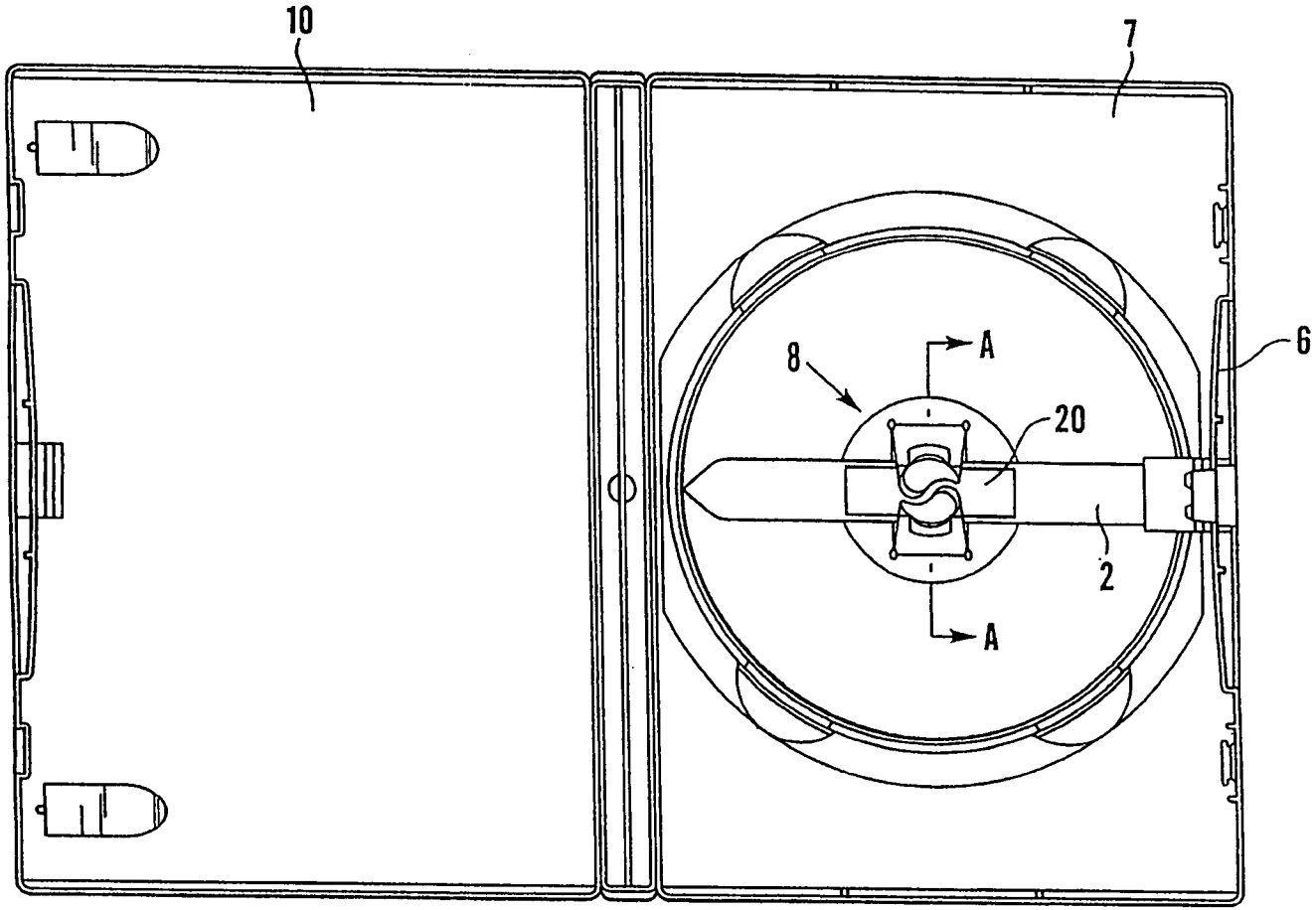
FIG. 13 is a plan view similar to FIG. 11, but showing the position of the security device when fully inserted into the container.
Figure 14:
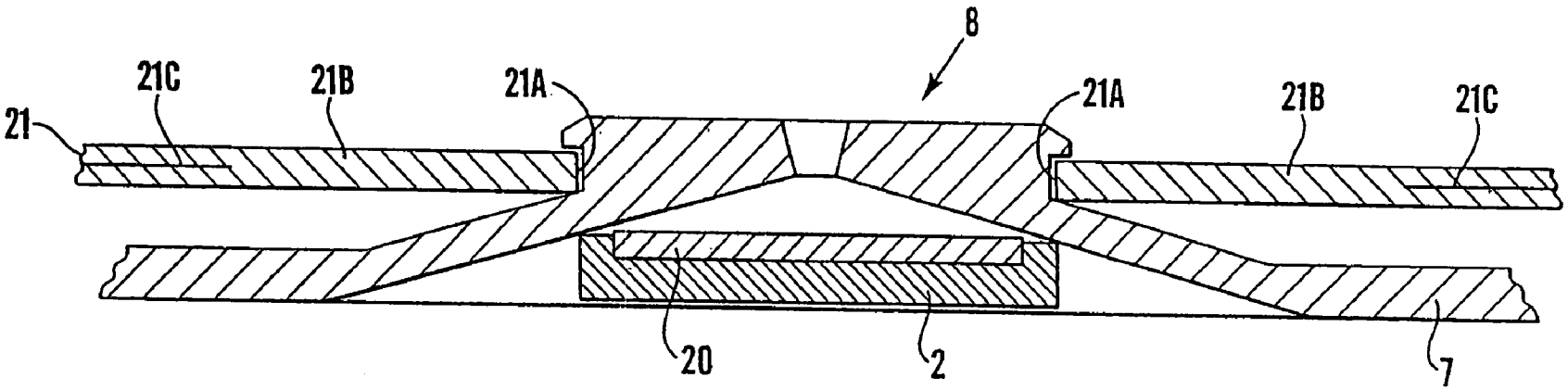
FIG. 14 is a schematic cross-section on line A-A of FIG. 13.

FIG. 14 shows a schematic cross-section on line A-A of FIG. 13 through the disk holding means 8, a disk 21 held thereon and an arm 2 of a security device 1 located under the disk holding means 8. A transponder 20 is schematically shown mounted on the arm 2 of the security device 1 so as to be located adjacent the disk 21 and in the vicinity of the central aperture 21A of the disk. FIG. 14 also shows the typical extent of a metal layer 21C embedded within the disk 21.

Figure 15:
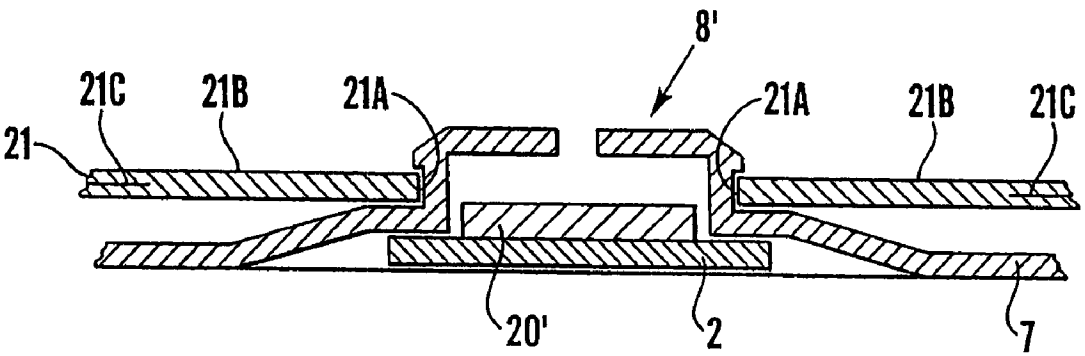
FIG. 15 is a similar schematic cross-section to that of FIG. 14, through another form of disk holding means of a container.

FIG. 15 shows a similar schematic cross-section through another form of disk holding means 8' which provides more space above the security device 1 in the vicinity of the central hole 21A of the disk 21, and which would thus enable a preferred embodiment of the invention to be implemented with an RF transponder 20' of slightly greater thickness (perpendicular to the plane of the disk) although, in cases where the security device 2 is inserted through a slot in the extended wall of the container (e.g. slot 5 shown in FIG. 15), this would require the slot to be made slightly larger too.

A similar arrangement can be used in apparatus designed to hold other articles which have a tendency to affect the correct functioning of the transponder. In some cases, the container may be adapted to hold two or more such articles, e.g. side by side, in which case the security device may be arranged so that the transponder lies in the vicinity of a gap between the articles, but preferably is arranged so that the transponder lies adjacent to only one of the articles (i.e. on the outside of the two or more articles).

The arrangements described in relation to FIGS. 10-15 have the additional advantage in that the head of the security device need not protrude significantly beyond the external walls of the container as the transponder is mounted within the container. This has the advantage that a thief will therefore find it difficult to mechanically compromise the security device.

Figure 16A:
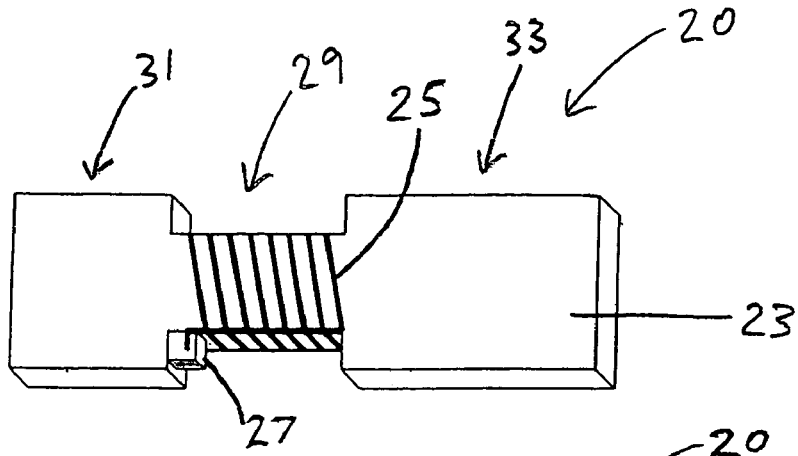
FIGS. 16A and 16B show two schematic illustrations of preferred transponders according to a preferred embodiment of the invention.
Figure 16B:
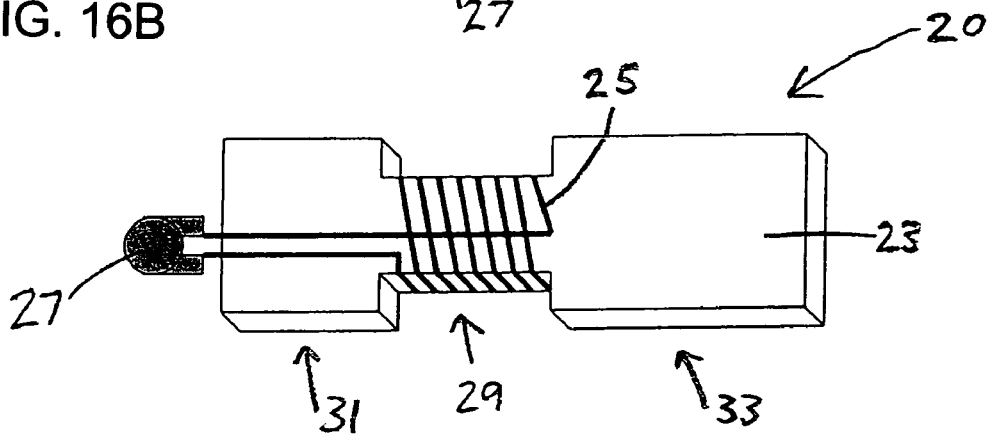

Views of FIGS. 16A and 16B illustrate schematically the basic form of preferred transponders according to the present invention. Each transponder 20 comprises a substantially flat strip 23 of magnetic material, preferably formed from a ferrite material (e.g. as described above). An elongate electrical conductor 25, preferably in the form of multi-stranded wire, is wound around the strip 23 along part of its length. A capacitor 27 electrically interconnects the opposite ends of the elongate electrical conductor. The capacitor 27 may be directly or indirectly attached to the strip 23 of magnetic material (as shown in view A) or it may be located away from the strip 23 (as shown in view B), for example.

The region 29 of the strip 23 around which the electrical conductor is wound is narrower in width than adjacent regions 31 and 33 of the strip. In use, the region 29 (carrying the wound conductor 25) preferably is located directly under a disk-holding means 8 of a disk container, for example as shown in FIGS. 13, 14 and 15. The fact that the region 29 of the magnetic strip 23 is narrower in this region than in the adjacent regions can provide the advantage that the strip 23 (which may be formed from brittle ferrite material) is supported by more material of the arm 2 of the security device 1 in this region, thus providing additional mechanical protection for the strip. The adjacent regions 31 and 33 of the strip may be of equal, or different, length.

Some preferred dimensions for the magnetic strip 23 are: (1) length of region 29: 10-50 mm, especially 20-30 mm, e.g. 25 mm; (2) overall length of the strip: 40-120 mm, especially 60-90 mm, e.g. 75 mm; (3) width of region 29: 3-10 mm, especially 4-8 mm, e.g. 6 mm; (4) width of regions 31 and 33: 5-20 mm, especially 7-15 mm, e.g. 10 mm; (5) thickness of strip: 0.3-5.0 mm, especially 0.5-2.0 mm, e.g. 1.0 mm.

Figure 17:
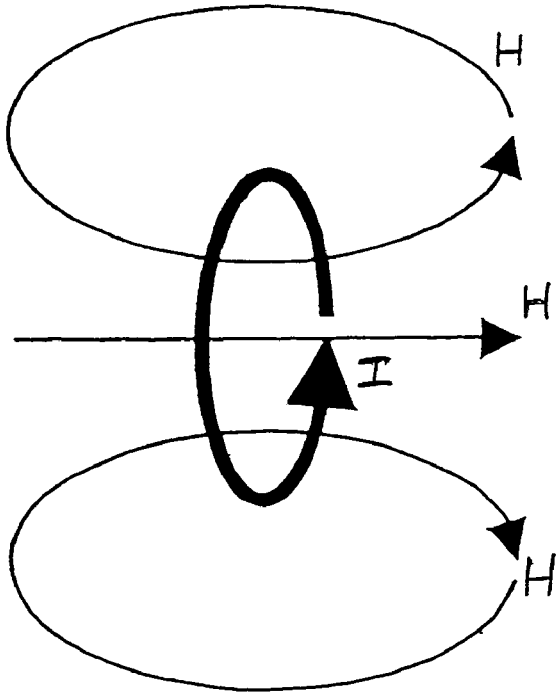
FIG. 17 is a schematic illustration of the magnetic dipole generated by the transponders shown in FIGS. 16A and 16B.

FIG. 17 is a schematic illustration of the generation of a magnetic dipole field H by means of a current I induced in the coil of the electrical conductor 25, showing that the axis of the dipole lies along at least part of the length of the strip 23 in the transponders 20 of FIGS. 16A and 16B.

Figure 18A:
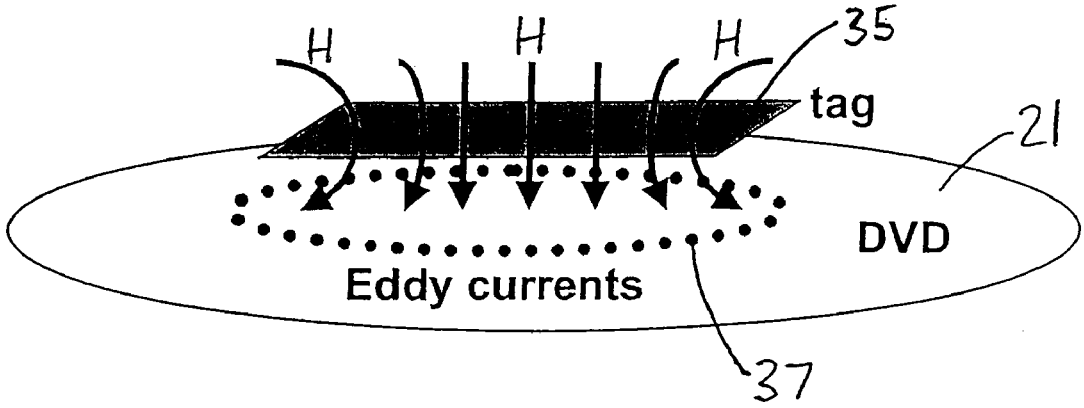
FIGS. 18A and 18B show two schematic illustrations comparing the generation of eddy currents in a metal layer of a DVD disk, by a prior art transponder (view (a)) and a transponder according to the present invention (view (b)).
Figure 18B:
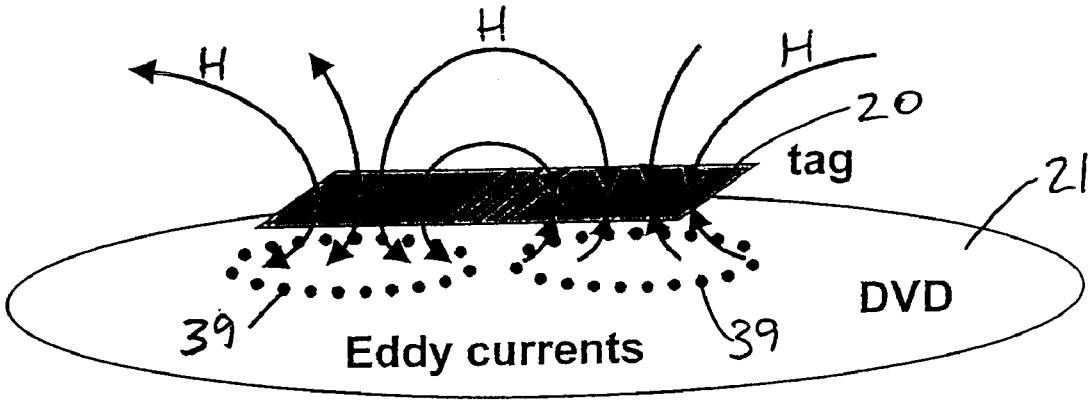

Views of FIGS. 18A and 18B are schematic illustrations comparing the generation of eddy currents in a metal layer of a DVD disk 21, by a prior art transponder 35 (view (a)) and a transponder 20 according to the present invention (view (B)). The prior art transponder 35 comprises a flat spiral of wire (not shown—the spiral of wire is enclosed in the flat tag shown) arranged to generate a magnetic dipole substantially perpendicular to the plane of the transponder. As illustrated schematically in FIG. 18A, the transponder 35 is most conveniently oriented substantially parallel to the disk 21, for example by attaching the transponder to a generally flat container for the disk (not shown, for clarity). However, when the transponder 35 is subjected to an appropriate applied magnetic field (e.g. by a store alarm unit), eddy currents 37 are generated by the transponder in the metal layer of the disk. Such eddy currents 37 flow around the magnetic field lines H from the transponder 35, and substantially mirror the current flow in the transponder. The effect is that the metal layer of the disk is strongly coupled to the transponder 35, and the magnetic field generated by the transponder 35 is therefore significantly reduced in strength. As explained above, this can mean that the theft of a disk from a store is not detected by the store's alarm unit.

In contrast, the corresponding magnetic field lines H and eddy currents 39 generated in a disk 21 by a transponder 20 according to a preferred embodiment of the invention oriented parallel to the disk, are shown in FIG. 18B. The magnetic field lines at each opposite longitudinal end of the transponder 20 are oriented generally parallel to the disk, and hence any eddy currents induced in the metal layer of the disk by these field lines tend to be insignificant. In the longitudinal centre of the transponder 20, the generated magnetic field lines at one end of the coil extend approximately perpendicular to the disk 21, and at the opposite end of the coil extend back into the transponder approximately perpendicular to the disk. Consequently, the eddy currents induced in the metal layer of the disk 21 by these magnetic field lines tend to flow in two counter-rotating loops 39. As a result, the coupling between the transponder 20 and the metal layer of the disk 21 is much less strong, and the attenuation of the magnetic field generated by the transponder is much less severe than is the case with the prior art transponder. Additionally, the presence of the usual hole in the middle of disk 21 can interrupt the paths of the two counter-rotating loops of eddy current, forcing the eddy currents to divert around the perimeter of the hole. This weakens the eddy currents further, and further reduces the attenuation of the magnetic field generated by the transponder according to a preferred embodiment of the invention. (This is in contrast to the prior art transponder shown in FIG. 18A, which is not significantly assisted by the hole in the disk, because the eddy currents generated by the prior art transponder generally circulate around the hole.) Consequently, the attempted theft of a disk from a store is much more likely to be detected by the store's alarm unit when a transponder according to a preferred embodiment of the invention is used, than is the case with the prior art transponder.

What is claimed as new and desired to be protected by Letters Patent of the United States is:

1. A security device for attachment to a container having external walls such that at least a signal receiving and/or transmitting portion thereof comprising an RF transponder is located externally of, or adjacent to, one of said external walls, the security device being arranged to trigger an alarm signal if the container is moved within the range of an alarm unit with the security device attached thereto, the security device having a releasable locking mechanism to secure it to the container such that release of the locking mechanism requires the use of authorized release means, and wherein the container is adapted to hold a substantially planar article, the article including a metal layer, and wherein the security device is located in a position substantially co-planar with said metal layer.

2. A security device as claimed in claim 1, having a first arm for insertion within a first aperture in the container.

3. A security device as claimed in claim 2, in which said first arm is a snap-fit within the container.

4. A security device as claimed in claim 1, in which the locking mechanism is releasable magnetically.

5. A security device as claimed in claim 2, having a second arm for insertion within a second aperture in the container.

6. A security device as claimed in claim 5, arranged such that the first arm fits within an aperture in a base portion of the container and the second arm fits within an aperture in a lid portion of the container, or vice versa.

7. A security device as claimed in claim 2, in which the container comprises a base portion and a lid portion, the lid portion being hingedly connected to the base portion along a first edge thereof, the first arm being arranged to fit within said first aperture which is provided in an opening edge of the container opposite said first edge.

8. A security device as claimed in claim 1, for attachment to a container having holding means for holding a disk via a central aperture thereof and which is arranged to interact with the holding means so as to lock the disk thereon.

9. A security device as claimed in claim 1, in which the RF transponder comprises a magnetic core with a cog wound therearound.

10. A security device as claimed in claim 9, in which the magnetic core is formed of ferrite.

11. A security device as claimed in claim 10, in which the magnetic core is substantially flat.

12. A security device as claimed in claim 9, having a cover portion which holds the transponder in the device.

13. A security device as claimed in claim 12, in which the cover portion is held in place by a snap-fit.

14. A security device as claimed in claim 1, in combination with a container adapted to receive the security device.

15. A security device as claimed in claim 1, in which the transponder of the security device is adapted to be housed within the container.

16. A security device for attachment to apparatus adapted to hold one or more articles which includes a layer which is non-transparent to electromagnetic radiation, the security device having a portion for receiving and/or transmitting electromagnetic radiation so as to trigger an alarm signal if the apparatus is moved within the range of an alarm unit with the security device attached thereto, said portion being located on the device such that it lies in the vicinity of a window in said layer or a gap between two such layers so as to be able to receive and/or transmit electromagnetic radiation through said window or gap when the device is attached to said apparatus.

17. A security device as claimed in claim 16, for attachment to apparatus adapted to hold a disk having a central aperture, said portion being located such that, in use, it lies adjacent the disk in the vicinity of the central aperture thereof.

18. A security device as claimed in claim 16, in which said portion comprises a flat coil of electrical conductors wound in elongate loops.

19. A security device as claimed in claim 16, in which said portion comprises a coil wound around a substantially flat ferrite core.

* * * * *